US010858149B2

(12) United States Patent
Vermeulen

(10) Patent No.: US 10,858,149 B2
(45) Date of Patent: Dec. 8, 2020

(54) GUIDING RAIL PROVIDED WITH INTERMEDIATE MATERIAL AND CONTAINER PROVIDED WITH SUCH GUIDING RAIL

(71) Applicant: CONTEYOR INTERNATIONAL NV, Merelbeke (BE)

(72) Inventor: Bart Vermeulen, Merelbeke (BE)

(73) Assignee: CONTEYOR INTERNATIONAL NV, Merelbeke (BE)

( * ) Notice: Subject to any disclaimer, the term of this patent is extended or adjusted under 35 U.S.C. 154(b) by 129 days.

(21) Appl. No.: 15/773,876

(22) PCT Filed: Mar. 8, 2016

(86) PCT No.: PCT/EP2016/054940
§ 371 (c)(1),
(2) Date: May 4, 2018

(87) PCT Pub. No.: WO2017/076516
PCT Pub. Date: May 11, 2017

(65) Prior Publication Data

US 2018/0319534 A1 Nov. 8, 2018

(30) Foreign Application Priority Data

Nov. 6, 2015 (CZ) ..... 2015-31737

(51) Int. Cl.
*B65D 19/06* (2006.01)
*B65D 19/38* (2006.01)

(52) U.S. Cl.
CPC ..... *B65D 19/06* (2013.01); *B65D 19/38* (2013.01); *B65D 19/385* (2013.01);
(Continued)

(58) Field of Classification Search
CPC ..... B65D 19/06; B65D 19/38; B65D 19/385
(Continued)

(56) References Cited

U.S. PATENT DOCUMENTS 8,033,388 B2 † 10/2011 Russell
8,308,015 B2 † 11/2012 Bradford
(Continued)

FOREIGN PATENT DOCUMENTS

DE 102007030079 A1 1/2009
GB 1297230 A 11/1972

OTHER PUBLICATIONS

International Search Report and Written Opinion of the International Searching Authority issued in PCT/EP2016/054940, dated Jun. 10, 2016; ISA/EP.

*Primary Examiner* — Rafael A Ortiz
(74) *Attorney, Agent, or Firm* — Harness, Dickey & Pierce, P.L.C.

(57) ABSTRACT

The present invention provides a guiding rail which can be used in storing and transporting devices provided with dunnage, which can be moved along the guiding rails. In a first aspect, the present invention discloses guiding rails (1) with a recess which is at least partially provided with an intermediate material. Said intermediate material can be in the form of a polymer insert (2) or in the form of a coating added during a painting and/or anodization process. The intermediate material allows to easily manipulate the flexible dunnage (9) along the guiding rails by pulling or pushing the dunnage, even when the force is applied centrally on the dunnage. Said insert can be divided in several components along a transversal line (8), allowing easy installation. In a second aspect, the present invention pres-
(Continued)

ents a device for storing and transporting goods, provided with guiding rails (1) with an intermediate material as described above.

18 Claims, 8 Drawing Sheets

(52) U.S. Cl.
CPC ..... *B65D 2519/0082* (2013.01); *B65D 2519/00338* (2013.01); *B65D 2519/00497* (2013.01); *B65D 2519/00582* (2013.01); *B65D 2519/00641* (2013.01); *B65D 2519/00791* (2013.01); *B65D 2519/00875* (2013.01)

(58) Field of Classification Search
USPC ..... 206/600, 386
See application file for complete search history.

(56) References Cited

U.S. PATENT DOCUMENTS

2006/0249415 A1* 11/2006 Nyeboer ..... B65D 19/06 206/485
2013/0175912 A1* 7/2013 Bradford ..... B65D 19/06 312/321
2014/0077674 A1* 3/2014 Bradford ..... B65D 85/68 312/321
2015/0069053 A1* 3/2015 Bradford ..... B65D 90/008 220/1.5
2015/0101956 A1 4/2015 Dobrinski et al.
2015/0136634 A1* 5/2015 Bradford ..... B65D 25/005 206/521
2015/0165759 A1* 6/2015 Landa ..... B41J 2/0057 347/103
2016/0340112 A1* 11/2016 Sanger ..... B65D 25/005

* cited by examiner
† cited by third party

GUIDING RAIL PROVIDED WITH INTERMEDIATE MATERIAL AND CONTAINER PROVIDED WITH SUCH GUIDING RAIL

CROSS-REFERENCE TO RELATED APPLICATIONS

This application is a U.S. National Phase Application under 35 U.S.C. 371 of International Application No. PCT/EP2016/054940, filed Mar. 8, 2016 and published in English as WO 2017/076516 A1 on May 11, 2017. This application claims the benefit of priority from Czech Republic Patent Application No. 2015-31737 filed Nov. 6, 2015. The entire disclosures of the above applications are incorporated herein by reference.

TECHNICAL FIELD

The invention pertains to the technical field of systems for transportation and storage of goods provided with guiding rails and flexible dunnage.

BACKGROUND

Handling units, like boxes, racks or other, provided with guiding rails supporting flexible movable dunnage, are well known in the art. These handling units with dunnage, manufactured of materials like plastic, woven textile or non-woven textile, are used to transport a variety of goods all over the world. It is essential that the dunnage can be easily manipulated by the factory workers, who only have a limited time to fill or empty the dunnage.

Motivated by its low weight and high tensile strength, aluminum is the standard material to produce such guiding rails. However, aluminum has a high coefficient of kinetic friction, obliging the workers using both hands on the dunnage (one hand on the left side close to the guiding rail, one hand on the right side close to the guiding rail) to slide the dunnage along the rails in the handling units. This issue is in particular, but not only, the case when the flexible dunnage is self-supportive and not supported by a solid dunnage support.

Transport devices with movable flexible dunnage can be divided in two categories. A first category of such transport devices comprises solid dunnage supports, like strut bars, which are mounted between the guiding rails by means of gliding elements. These transport devices need inventive systems to be collapsible when returned empty, which is a serious drawback for such transport devices. Moreover, when the dunnage support is skewed between the guiding rails, the dunnage can get blocked, due to the large friction between the gliding elements and the recess of the guiding rail. A second category comprises dunnage which is self-supportive, with gliding elements mounted directly on the dunnage or attached by means of a flexible connection like a textile band. Due to the absence of solid bars, these devices are easily collapsible, which is a considerable advantage. However, when manipulating such flexible dunnage lacking a dunnage support, a considerable normal force acts on the gliding element, which results in a large friction and often a blockage of the dunnage.

Hence, there remains a need in the art for an improved transport system with guiding rails and movable dunnage with or without solid dunnage supports, enabling easy manipulation of the dunnage along the guiding rails.

The present invention aims to resolve at least some of the problems mentioned above.

The invention thereto aims to provide an improved guiding rail, both inexpensive, enabling easy and effortless manipulation of the dunnage with or without dunnage supports and easy to install. In particular, the object of the current invention allows a one-hand operation when moving the dunnage in the box, which enhances greatly the efficiency of the operators of such devices.

SUMMARY OF THE INVENTION

The present invention provides an improved guiding rail which can be used in storing and transporting devices provided with dunnage, which can be easily and effortlessly moved along the guiding rails, preferably by a one-hand operation.

In a first aspect, the present invention discloses guiding rails provided with a recess in the longitudinal direction of said rail, whereby said recess is at least partially provided with an intermediate material, according to claim 1. Said intermediate material can be in the form of a polymer insert, according to claim 2, or in the form of a coating added during a painting and/or anodization process, according to claim 6. The intermediate material allows easy one-handed manipulation of the flexible dunnage along the guiding rails by pulling or pushing the dunnage, even when a force is applied centrally on the dunnage.

In a second aspect, the present invention provides a device for storing and transporting goods, according to claim 14, provided with such guiding rails provided with an intermediate material as described above.

DETAILED DESCRIPTION OF THE INVENTION

Figure 1:
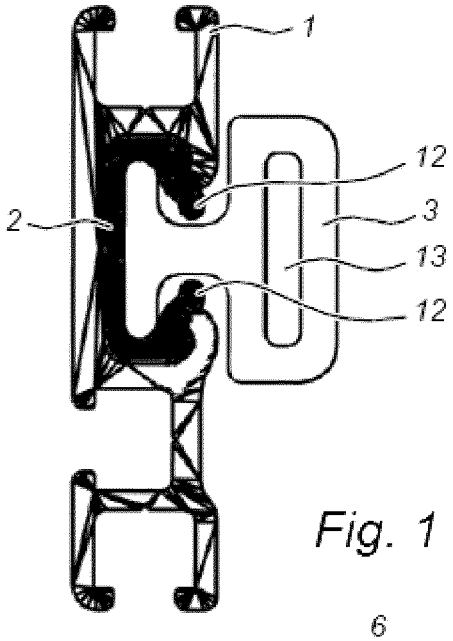
In FIG. 1 a cross section of a polymer insert according to an embodiment of the current invention is shown as mounted in the guiding rail. A gliding element is also provided.

The present invention concerns an improved guiding rail which can be used in storing and transporting handling units provided with guiding rails and flexible dunnage. This flexible dunnage can be self-supportively mounted between the guiding rails by means of gliding elements at both ends. Alternatively, the flexible dunnage can be provided with at least one solid dunnage support, to which gliding elements are provided. These gliding elements are placed in the recess of the guiding rail. This document discloses how the recess of the guiding rail is at least partially provided with an intermediate material. The intermediate material enables easy manipulation of the dunnage along the guiding rail by pushing or pulling, even with one hand in the center of the dunnage.

Unless otherwise defined, all terms used in disclosing the invention, including technical and scientific terms, have the meaning as commonly understood by one of ordinary skill in the art to which this invention belongs. By means of further guidance, term definitions are included to better appreciate the teaching of the present invention.

As used herein, the following terms have meanings as described below.

The term "dunnage" refers to the assembly of one or more pockets mounted in the transport device. The dunnage can be suspended between the rails by means of a dunnage support, which connects the dunnage with the guiding rails by means of gliding elements. Said dunnage support comprises a strut bar manufactured of materials comprising hard or soft plastic. Alternatively, the flexible dunnage can be suspended between the guiding rails without the use of a dunnage support. In this case, the dunnage is self-supportive and the gliding elements are mounted directly on the dunnage, for instance by means of a flexible connection like a textile band, which is moved in the slot of the gliding element and stitched or sewn to the flexible dunnage for fixation.

The term "to be slidably fitted in a rail" means that an element is fitted in the rail, but it is able to move along the recess of the rail.

In a first aspect, this current invention discloses a guiding rail, provided with a recess in the longitudinal direction of the rail. This rail is suitable for receiving gliding elements of a movable dunnage structure like suspended pockets. To improve the ease of manipulation of said dunnage, an intermediate material is provided to the recess of the guiding rail. This intermediate material is at least partially covering the recess of the guiding rail, but can also completely cover the recess of the guiding rail. The cross section of the recess of said guiding rail can be approximately U-shaped or C-shaped. Said guiding rails are manufactured of materials comprising aluminum, steel, plastic or a combination thereof.

As a possible embodiment of said intermediate material provided to the recess of the guiding rail, the invention provides an intermediate material in the form of a polymer insert that can be plugged in in the recess along the longitudinal direction of a guiding rail. The insert covers the recess at least partially along its length, but can also span the entire length of said recess. Gliding elements can be slidably fitted in the insert and interconnect the insert of the guiding rail and the dunnage. The insert comprises lips suitable for partly enclosing said gliding element, inhibiting the removal of the gliding element from the insert. The lips of the insert fold inwards towards the recess of the guiding rail and are bent along the edges of the recess of guiding rail. Both the distal and the proximal end of the guiding rail are at least partially covered by an end cap, closing the recess of the insert and thus preventing the loss of the gliding elements. These improved guiding rails are specifically designed for use in transporting devices with suspended pockets, but can also be applied in other systems with guiding rails. Therefore, the use of said inserts in guiding rails is not limited to the examples provided in the text.

In a preferred embodiment of the invention, the insert comprises at least one division along a transversal line, hence the insert can be subdivided in at least two components. Inserts are often long and can be slightly curved. It is not straightforward to slide such long insert along the recess from the proximal end to the distal end of the guiding rail, as the curvature of the insert generates tension during installation. Alternatively, several short inserts can be placed in the recess of the long guiding rail and cover as such the entire length of the recess. However, it is necessary to partly disassemble the transport device and to remove the end caps to install such inserts. This is a highly inconvenient and time-consuming process. The installation process of said insert components with a division along the transversal line is much more convenient, because the shape of the recess of the guiding rail and the shape of the insert components allow that the insert components are clicked in the recess of the guiding rail without disassembling the transport device or removing the end caps of the guiding rails.

In a preferred embodiment, a portion of the guiding rail is insert-free. Said portion is preferentially at the distal or proximal end of the guiding rail. This insert-free opening allows installing the gliding elements in the guiding rails without disassembling the transport device, because the opening of the recess of the guiding rails is large enough to insert the gliding elements. Once the gliding element is included in the recess of the rail, it can be moved further into the insert present in the guiding rail. The lips of the insert impede the removal of the gliding element from the insert, because the opening between the lips is smaller than the foot of the gliding element. Once the gliding elements of the dunnage are installed via the insert-free opening of the guiding rail, a blocking element can be mounted on the insert-free position of the guiding rail, preventing the escape of the gliding elements when moving the dunnage along the guiding rails.

In an embodiment, the insert is by preference manufactured of a polymer with a low friction coefficient. As a consequence, the suspended pockets can be easily manipulated along the guiding rails in transporting boxes by pulling or pushing the dunnage in the center with one hand, even if the dunnage is not supported by bars and is flexible or bendable. In the transport devices known in the state of the art, moving suspended pockets, especially those without solid dunnage supports, along the guiding rails can be complicated, because the gliding elements get blocked in the guiding rails, especially when only one hand is used in the center of the dunnage support. Therefore, two hands are necessary to move the dunnage of current transport devices, applying one hand on the left side and one hand on the right side of the dunnage support, both hands close to the guiding rail on each side. This is a big disadvantage and hampers efficient work.

The polymer used for the insert has by preference a density of between 0.9 and 1.5 g/cm$^3$, but preferentially a density of at least about 0.91 g/cm$^3$. The tensile stress of said polymer ranges between 18 and 25 N/mm$^2$, but is preferentially larger than about 19 N/mm$^2$. Furthermore, said polymer has an elongation at break between 45% and 60%, preferentially larger than 50%. The E-modulus of the polymer covers values between 650 N/mm$^2$ and 800 N/mm$^2$ and is preferentially larger than 700 N/mm$^2$. The polymer requires between 4 and 5 N/mm$^2$ compression stress at 1% nominal upset, preferentially 4.5 N/mm$^2$ compression stress. The polymer also needs a compression stress between 6 N/mm$^2$ and 10 N/mm$^2$, preferentially 8 N/mm$^2$, at a nominal upset of 2%. Finally, the polymer needs a compression stress between 12 N/mm$^2$ and 16 N/mm$^2$ at 5% nominal upset. Additionally, the polymer requires a notched impact stress between 100 and 150, preferentially larger than 118. The polymer has a ball pressure hardness between 35 N/mm$^2$ and 45 N/mm$^2$, preferentially about 39 N/mm$^2$. The polymer has a Shore D hardness between 55 and 70, preferentially above 60, and, an abrasion resistance (measured with a Sand Slurry test) between 70% and 90%, preferentially about 80%.

It was found by the inventors of the current invention that polymers complying with one or more ratios as mentioned above, were proven to be particularly beneficial in the framework of the current invention.

In an embodiment, the polymer insert comprises a polymer selected from polyolefins such as High-density polyethylene (HDPE), Ultra-high-molecular-weight polyethylene (UHMWPE), Medium density polyethylene (MDPE), polypropylene, polyurethane, polystyrene, cross-linked polyethylene (PEX or XLPE), polyoxymethylene (POM), or lubricated or modified versions of any of the polyolefins stated above to create lower friction coefficients.

In an alternative embodiment of the invention, the intermediate material provided between the recess of the guiding rail and the gliding elements comprises a coating added during a painting and/or anodizing process to the recess of the guiding rail. The coating covers the recess at least partially, but can also completely cover the recess. Lips are provided at the edges of the coated recess of the guiding rail, bending inwards towards the recess. These lips are enclosing the gliding elements and prevent the removal of said gliding elements. An end cap covering at least partially the recess of the guiding rail is provided at both ends of the guiding rail. The gliding elements mounted in the coated recess of the guiding rail allow the uncomplicated manipulation of the flexible dunnage.

The painting and/or anodization layer is applied with a thickness between 5 and 200 micron, preferentially between 10 and 150 micron. In an embodiment, the coating can comprise a polymer like polytetrafluoroethylene (also known as Teflon), WS2 (Tungsten disulfide) or lubricant paint. In this case, no polymer insert is used, but due to the properties of the polymer, the gliding element can move along the guiding rails without large amounts of friction. Due to the lack of an insert, lips are provided on the guiding rail, preventing the gliding elements of being removed from the recess of the guiding rail.

The guiding rails are made of materials comprising aluminum, plastic, steel or a combination thereof. These materials are frequently used to produce such rails, because of their low weight and high tensile strength. The insert is manufactured of a polymer with a kinetic friction coefficient between 0 and 0.12 in dry condition. Preferentially, the coefficient of friction between 0 and 0.1, more than ten times lower than the friction coefficient of aluminum. Due to the properties of the polymer of the insert or the recess coating, the dunnage can be easily manipulated along the guiding rails, in contrast to the complicated sliding of the dunnage in current transport devices with aluminum, plastic or steel guiding rails.

In a particularly preferred embodiment, the gliding elements mounted on the dunnage or on the dunnage supports are replaceable. These elements can be fragile and can require replacement after multiple use of the transport system, especially when heavy goods are carried in the dunnage. Moreover, if the inserts are innovated and are provided with a different improved opening, it is possible to also alter the gliding element. The replacement process of both the insert and the gliding element is fast and inexpensive, especially in the case the insert has a division along a transversal line as described above and the insert components can be clicked in the guiding rail without the need to disassemble the transport device. Further costs are reduced, because the guiding rails do not need replacement and the installation of the innovative insert can be performed without replacing the transporting boxes.

In an alternative embodiment, the foot of a gliding element has a width smaller than twice the height of the foot of said element. Preferentially the width of the foot is smaller than the height of the foot of the gliding element. Hereby, the foot of the gliding element refers to that part of the gliding element that is introduced in the insert of the guiding rail or in the coated recess of the guiding rail. The width of said foot involves the size of the foot parallel to the guiding rail once the gliding element is mounted (hence parallel to the moving direction). The height refers to the vertical size of the foot once mounted in the horizontal guiding rail (hence orthogonal to the moving direction). The width of the gliding element is important when taking the piece goods out of the transport device: when the piece goods are removed, the operator closes the dunnage and slides the empty dunnage towards the proximal end of the guiding rail. Therefore, empty dunnage is accumulating on the side of the operator while emptying the dunnage and the distance to the closest dunnage loaded with piece goods is increasing. This is highly inconvenient for the operator, who can suffer back pains if it is necessary to reach far for the piece goods. The width of the emptied dunnage is determined by the width of the gliding elements, hence the smaller the width of the gliding elements, the smaller the width of the accumulated emptied dunnage and the more convenient the operator can remove the piece goods.

The invention also discloses a device, like a handling unit such as a container, a rack or other, used for holding product therein during storage and shipment, the product being two-dimensional or three-dimensional piece goods. The container comprises a bottom and at least two sides, erecting from said bottom, and at least one set of guiding rails supported by the container sides. A lid can be provided to cover the upper side of the container. The container can be manufactured of materials comprising steel (e.g. to form a rack), plastic (e.g. to form a box), wood (e.g. to form a pallet) or a combination thereof. Gliding elements are engaged with and slidable along a longitudinal recess of said guiding rails. A dunnage structure is movably coupled at both sides to the container by means of the gliding elements and operable for being slid along the guiding rails to vary the position of the dunnage structure and to receive product within the container. The dunnage can be self-supportive or can be mounted on solid dunnage supports, like strut bars. The recess of said guiding rails is at least partially provided with an intermediate material in order to facilitate the manipulation of the dunnage along the guiding rails. The intermediate material comprises a polymer insert or a coating added during a painting and/or anodization process, as described above.

In a possible embodiment of the invention, the dunnage comprises flexible pockets having U-shaped cross sections, suitable for storing and transporting flat, substantially two-dimensional or three-dimensional objects. The dunnage can be supported by at least one dunnage support provided with gliding elements on both sides and manufactured from solid materials like hard plastic. Alternatively, the dunnage can be self-supportive and the gliding elements can be attached directly to the dunnage. The flexible dunnage is made of materials comprising plastic, woven textile, non-woven textile or a combination thereof. The guiding rails are provided over the entire length with an intermediate material like a polymer insert, plugged into the recess of said guiding rails. The gliding elements are placed in the opening of the insert and enable moving the dunnage along the guiding rails without suffering a disturbing amount of friction. Alternatively, a coating can be added during the painting and/or anodization process of the recess of the guiding rail, whereby the friction during the manipulation of dunnage is also vastly reduced. Said coating can be applied by any technique available in the State of the art known by the skilled person. This way the transported goods can be easily stored and arranged in the dunnage of the box, optimizing the use of available storage space. As a consequence, more goods can be transported within the same volume or container, reducing the costs of shipping for a factory. Due to the low friction when moving the dunnage, significant time savings can be achieved and the transport device is more user friendly.

In a preferred embodiment, said transport device is foldable or collapsible before and after use. Methods and techniques to fold the reusable and returnable containers are well known in the State of the Art. Such containers for holding product therein during shipment and subsequently being returned generally empty of product for reuse comprise a body configured for being manipulated into an erected position for containing a product placed therein during shipment and for subsequently being manipulated into a collapsed position for reducing the size of the container for return. An integrated dunnage structure is coupled to the body and is operable for moving into an engagement position when the container body is erected to thereby engage a product placed in the container for shipment. The dunnage structure is further operable for moving into a relaxed position when the container body is collapsed so that the container and dunnage structure may be returned together for reuse. The container provides reusable dunnage which is usable with the container when it is shipped and subsequently remains with the container when it is returned for being reused when the container is again shipped. In a preferred embodiment, pliable dunnage pouches are suspended in the container and collapse when the container is collapsed. The dunnage has to be manipulated regularly in these collapsible containers. Therefore, the use of a guiding rail with an intermediate material in the recess, like a polymer insert or a coated recess, are advantageous in this type of containers.

The solid dunnage supports can be produced of materials comprising plastic. The dunnage is manufactured from flexible materials, comprising textile or plastic or a combination thereof. In a particular embodiment, this flexible dunnage has a U-shaped cross section. However, this document is not intended to limit the material or the shape of the dunnage.

The invention is further described by the following non-limiting examples which further illustrate the invention, and are not intended to, nor should they be interpreted to, limit the scope of the invention.

FIGURES

In what follows, the different figures are described in more detail.

In FIG. 1 a cross section is shown of a guiding rail (1) with an insert (2), appearing in solid black, and a gliding element (3). Both the insert and the recess of the guiding rail are largely C-shaped or U-shaped. The lips (12) of the insert (2) fold inwards towards the recess of the guiding rail and are bent along the recess of the guiding rail. Said lips are preventing that the foot of the gliding element (3) can be removed from the recess of the insert (2), hence the gliding elements are engaged with the insert of the guiding rails. In a preferred embodiment, the foot of the gliding element (3) can be introduced in the recess of the guiding rail (1) on a position the insert is not provided. The dunnage is mounted on the gliding elements either by means of dunnage supports, which comprise plastic strut bars, or by means of textile (or other flexible) connections. These textile connections are provided with a textile band inserted in the slot (13) of the gliding element (3) and sewed or stitched on said pocket. Moreover, the textile connections can be directly integrated in the flexible material of the dunnage.

Figure 2:
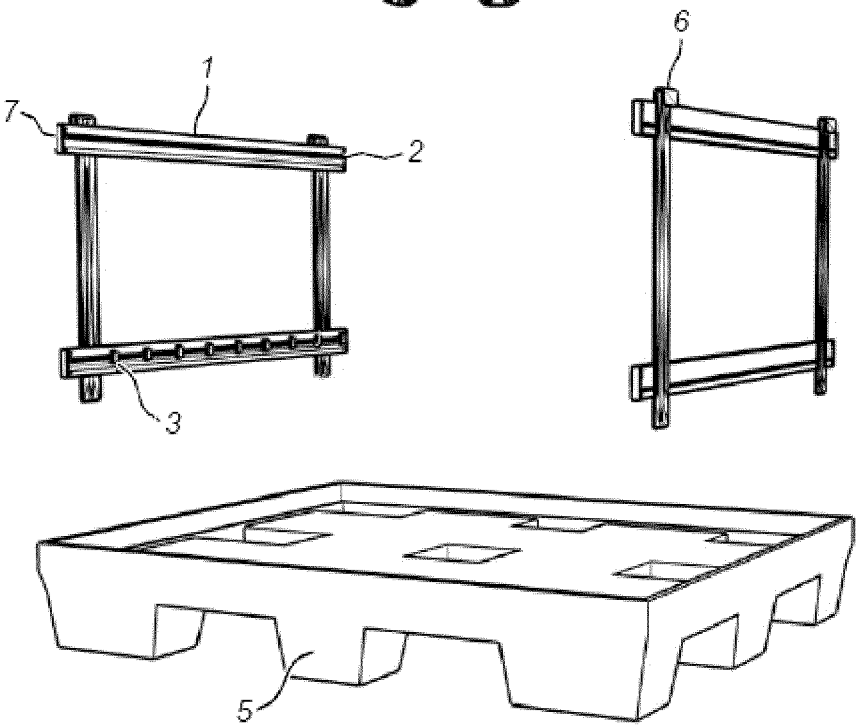
In FIGS. 2 and 5, schematic views of transporting devices according to an embodiment of the current invention with guiding rails are presented.

In FIG. 2 a schematic view of a transporting device according to an embodiment of the current invention is illustrated, omitting the side walls of the transporting device to demonstrate the arrangement of the rails (1) with inserts (2). The base (5) of the transporting device is indicating the size of the transporting device. Gliding elements (3) are positioned in the insert (2), allowing easy manipulation along the rails with low friction. Two sets of rails (1) are provided, hence the device is suitable for the arrangement of two levels of dunnage, as further demonstrated in FIG. 5. The hook elements (6) are provided to place the system with rails in the transport device, allowing easy manipulation of the rail system. Alternatively, the rail system can be attached directly to the side walls of the device, for instance by means of screws. The guiding rails (1) with inserts (2) are closed by means of an end cap (7), inhibiting the removal of the gliding elements.

Figure 3:
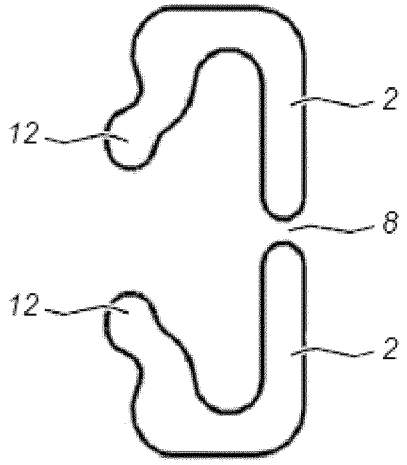
In FIGS. 3 and 4, an insert according to an embodiment of the current invention with a division line is presented.

In FIG. 3 the cross section of an insert (2) with a transversal division (8) and two lips (12) is shown. The lips bend slightly inwards towards the recess, resulting in an approximately J-shaped insert component. To install the components of the insert in the recess of the guiding rail, the components can be clamped in the recess of the latter. In an alternative embodiment, the two parts of the insert can be connected by a clicking mechanism that can be optionally provided along the division line.

Figure 4:
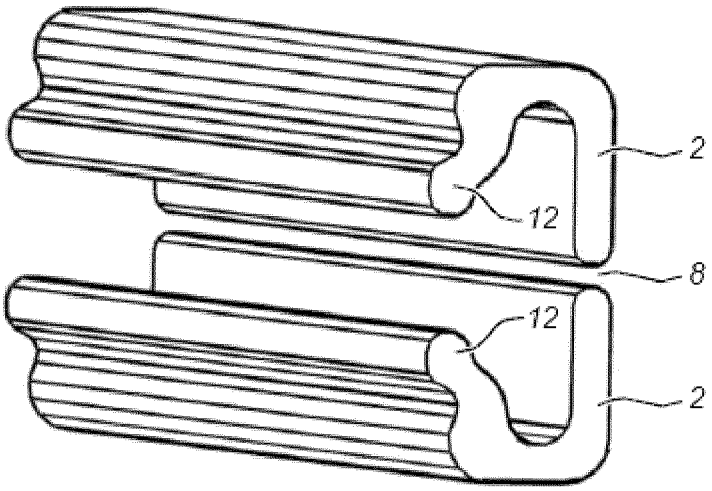

In FIG. 4 an orthographic view is shown of an insert (2) with a division line (8) and lips (12).

Figure 5:
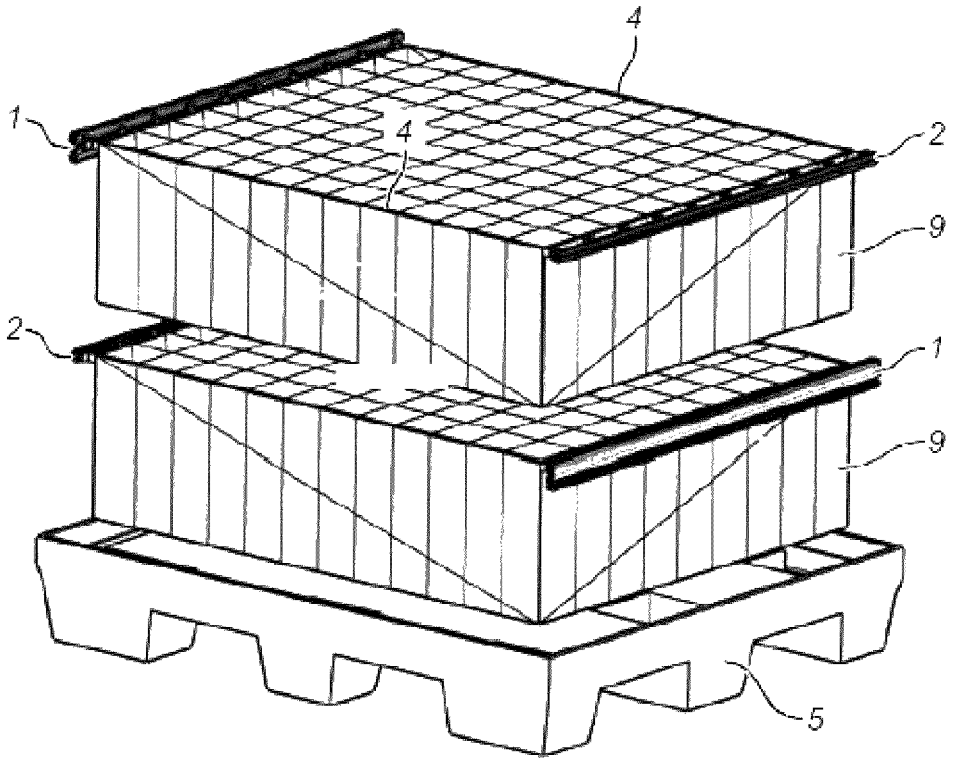

In FIG. 5 a schematic view is shown of an embodiment of a transport device with a base (5) and dunnage (9) provided with dunnage supports (4), manufactured from materials comprising hard plastic. The dunnage can also be self-supportive, hence lacking a solid dunnage support. Two levels of dunnage (9) are mounted on the two sets of guiding rails (1) with inserts (2). To illustrate the difference between the guiding rail (1) and the insert (2), on the left side of the lower dunnage (9) and on the right side of the upper dunnage (9), only the insert is presented, without the guiding rail. However, in practice, the insert (2) will always be mounted in the recess of a guiding rail (1).

Figure 6A:
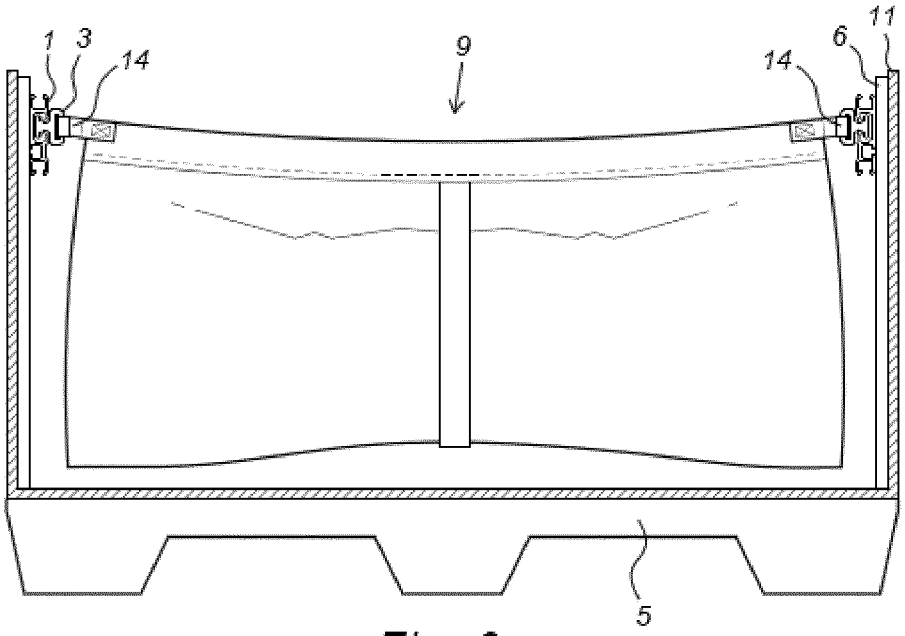
In FIG. 6 cross sections of a transporting box according to an embodiment of the current invention with flexible dunnage are shown, both with flexible dunnage being self-supportive (FIG. 6*a*) and with dunnage supports like solid strut bars (FIG. 6*b*).

In FIG. 6*a* a cross section is shown of an embodiment of a transporting device with base (5) and at least two side panels (11). The guiding rails (1) are mounted on the transporting device by means of an attachment system like hooks (6). Similarly, the guiding rails (1) can be attached directly to the container sides (11) by means of screws. Gliding elements (3) are placed in the insert and connect the guiding rail (1) with the dunnage (9) by means of a flexible connection like a textile band (14). This textile band (14) is inserted in the slot of the gliding elements (3) and is stitched or sewn to the dunnage supports of the flexible pockets. This connection (14) can also be integrated in the shape and material of the dunnage. The flexible dunnage of this embodiment is manufactured of woven or non-woven textile and is sagging due to the weight of the piece goods. No dunnage supports are provided, hence the dunnage is self-supportively mounted between the rails by means of gliding elements. Such transport device without dunnage supports is easily collapsible. However, this sagged flexible dunnage is difficult to move along the guiding rails known in the State of the Art. However, due to the inclusion of the insert in the guiding rail (or alternatively due to the application of coating on the recess of the guiding rail), the dunnage can effortlessly slide along the guiding rails.

Figure 6B:
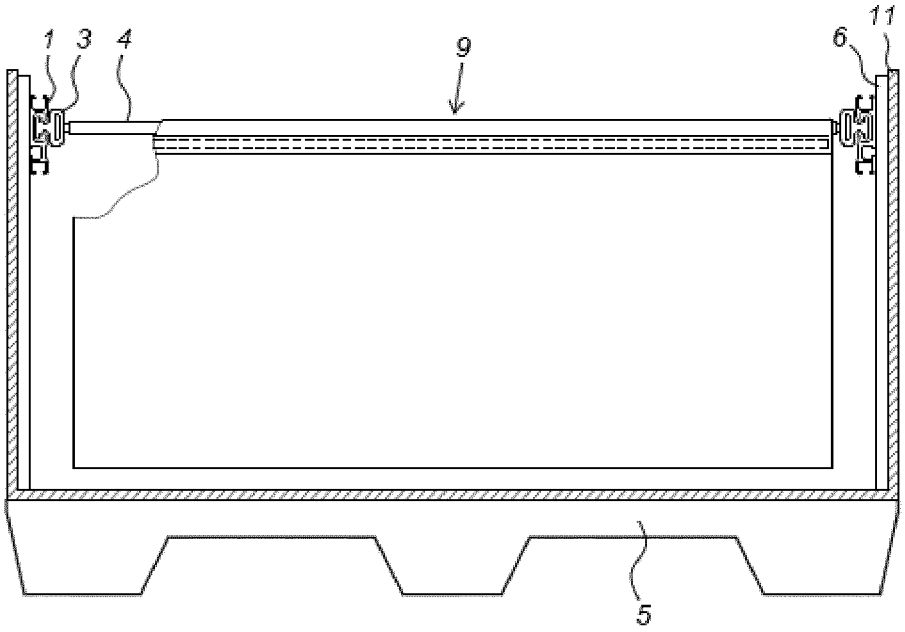

In FIG. 6*b* a cross section of a similar embodiment of a transporting device with guiding rails (1) provided with a polymer insert (or with friction-reducing coating) is shown. However, this embodiment comprises dunnage supports (4) which are manufactured of a solid material comprising plastic. Therefore, these do not sag due to the weight of the piece goods. However, the transport container is not easily collapsible due to the use of solid strut bars. Gliding elements (3) are mounted on both sides of the dunnage supports and inserted in the recess of the guiding rail.

Figure 7:
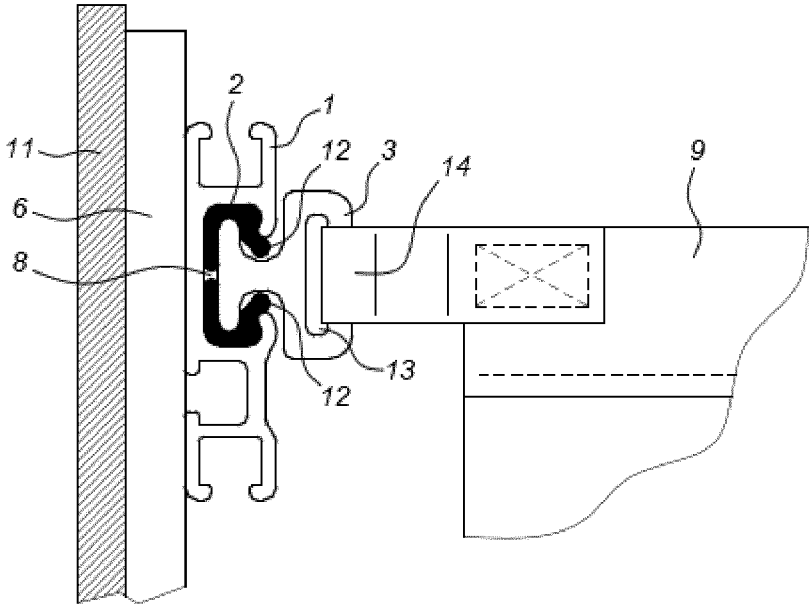
FIGS. 7 and 8 present detailed views on the mounting of the dunnage by means of gliding elements in the insert of the guiding rail according to an embodiment of the current invention.

In FIG. 7, a detailed cross section of an embodiment of a mounted guiding rail (1) with insert (2) is shown. The insert comprises two insert components, transversally divided by a division line (8). The guiding rail is attached to the side panel (11) of the transporting device by means of an attachment system (6). In an alternative embodiment, the guiding rail (1) can be directly screwed on the side panel (11) of the transport device. The dunnage (9) is provided with a connection like a textile band (14), which is inserted in the slot (13) of the gliding element (3) and stitched or sewn on the dunnage (9). The gliding element (3) is slidably mounted in the insert (2) of the guiding rail (1).

Figure 8:
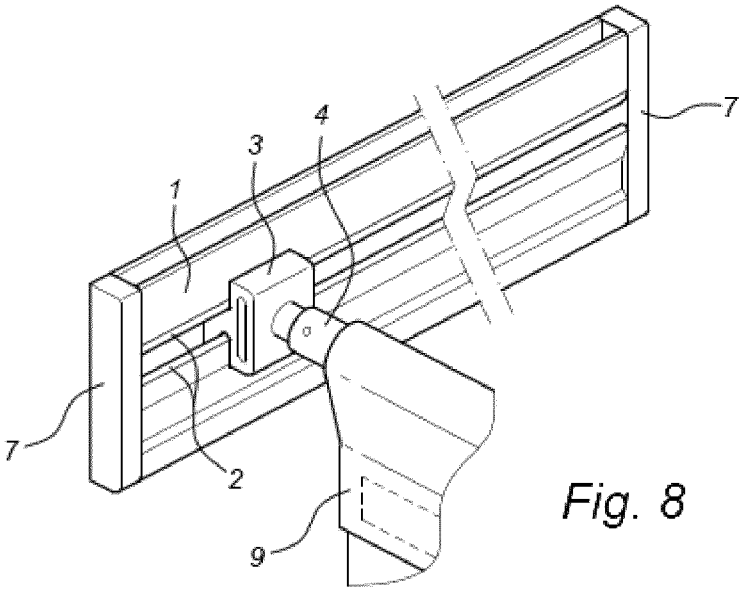

In FIG. 8, a detailed view of an embodiment of a guiding rail (1) with insert (2) is presented. Both the distal and proximal ends of the guiding rail (1) are at least partially covered by an end cap (7), inhibiting the gliding elements (3) that are placed in the insert (2) can be removed. The dunnage (9) is mounted on the dunnage support (4), which is connected to the insert (2) of the guiding rail (1) by means of a gliding element (3).

Figure 9:
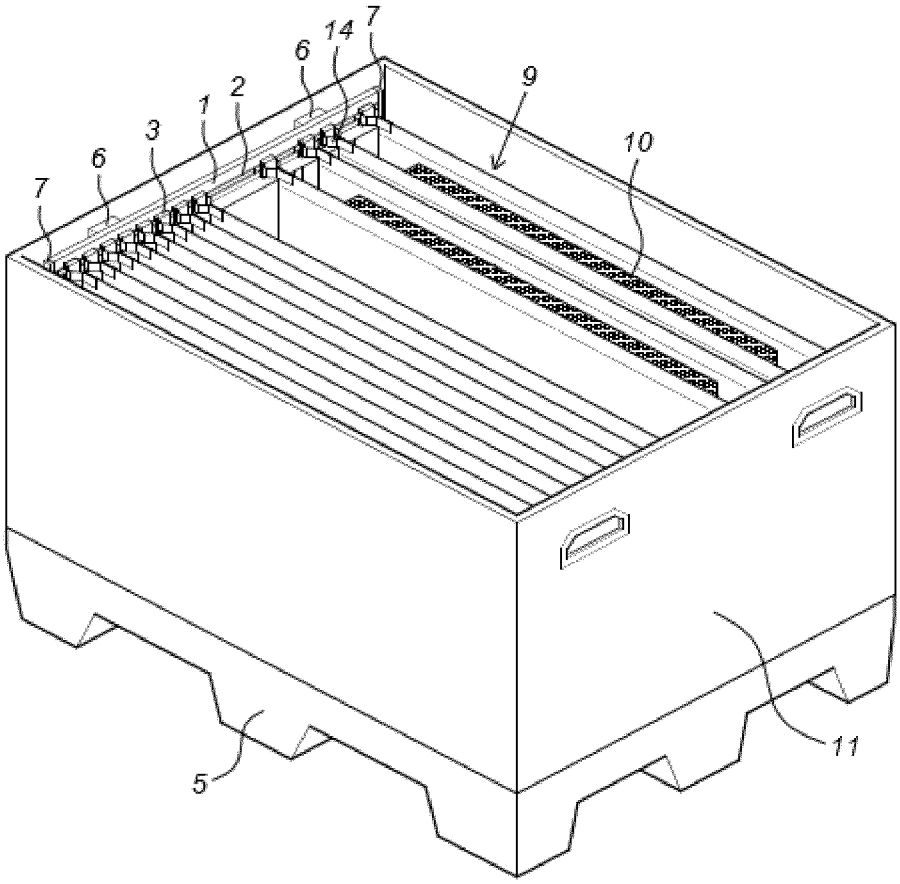
FIG. 9 shows a transport device according to an embodiment of the current invention provided with guiding rails with a polymer insert.

In FIG. 9 an embodiment of a transport device with a base (5) and side panels (11) is shown. The guiding rails (1) with inserts (2) are attached to the side panels (11) by using an attachment system (6), for instance hooks or screws. The gliding elements (3) are placed in the insert (2) of the guiding rail (1) and connect the dunnage (9) with the guiding rail (1). Some of the dunnage is loaded with piece goods (10), other part of the dunnage (9) is empty and is arranged on one side of the transport device, which is in practice often the side of the operator who is emptying the transport device. Note that the width of the accumulated empty dunnage is determined by the width of the gliding elements. For easy removal of the piece goods, it is essential that the operator does not have to reach too far to take the piece goods. Therefore, it is important to limit the width of the gliding elements.

Figure 10:
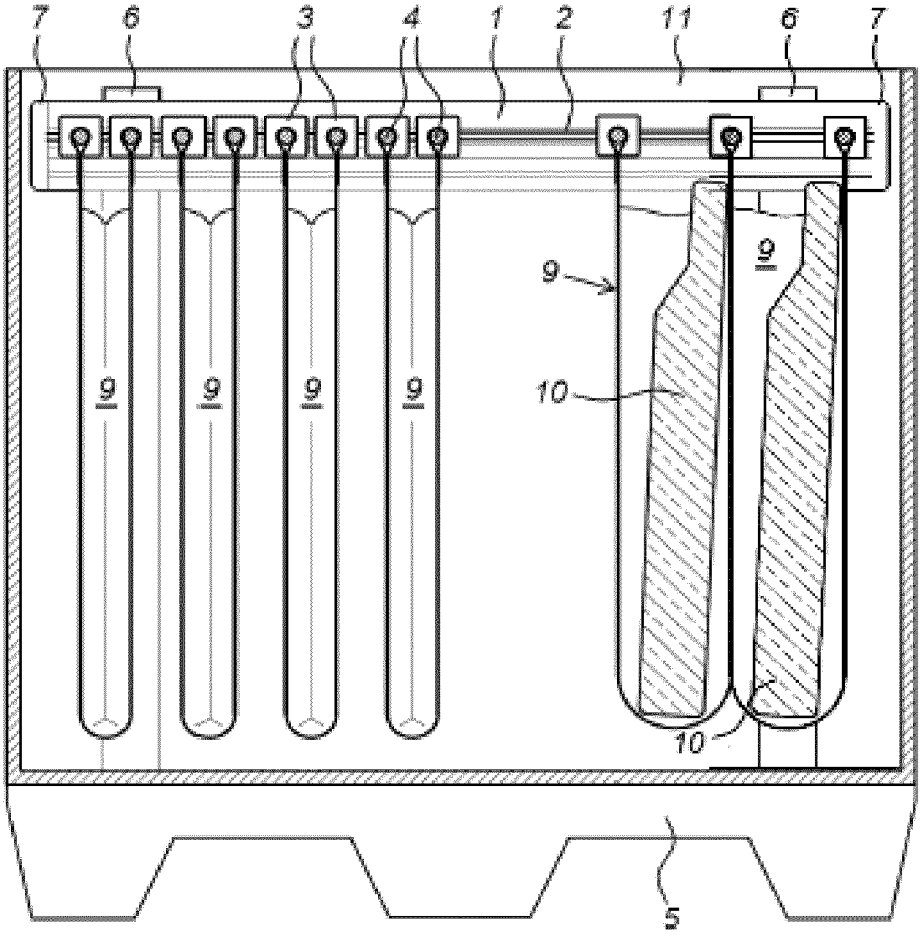
FIG. 10 shows a cross section of a transport device according to an embodiment of the current invention provided with guiding rails with a polymer insert.

In FIG. 10, a cross section of an embodiment of a transport device is presented. As in FIG. 9, some dunnage (9) is empty, while other dunnage (9) contains largely two-dimensional or three-dimensional piece goods (10). The guiding rail (1) is connected to the transport device with an attachment system (6) and is closed by end caps (7) on both ends. The gliding elements (3) are slidably fitted in the insert (2) of the guiding rail and connect the dunnage supports (4) of the suspended pockets (9) with the guiding rails (1). The cross section of the suspended pockets is U-shaped in this particular embodiment. Two types of suspended pockets are illustrated: on the left side of the figure, the different suspended pockets are independent of each other, while on the right side of the figure, the suspended pockets are connected and share one wall. The suspended pockets can be made of materials comprising woven or non-woven textile, plastic or a combination thereof.

Figure 11:
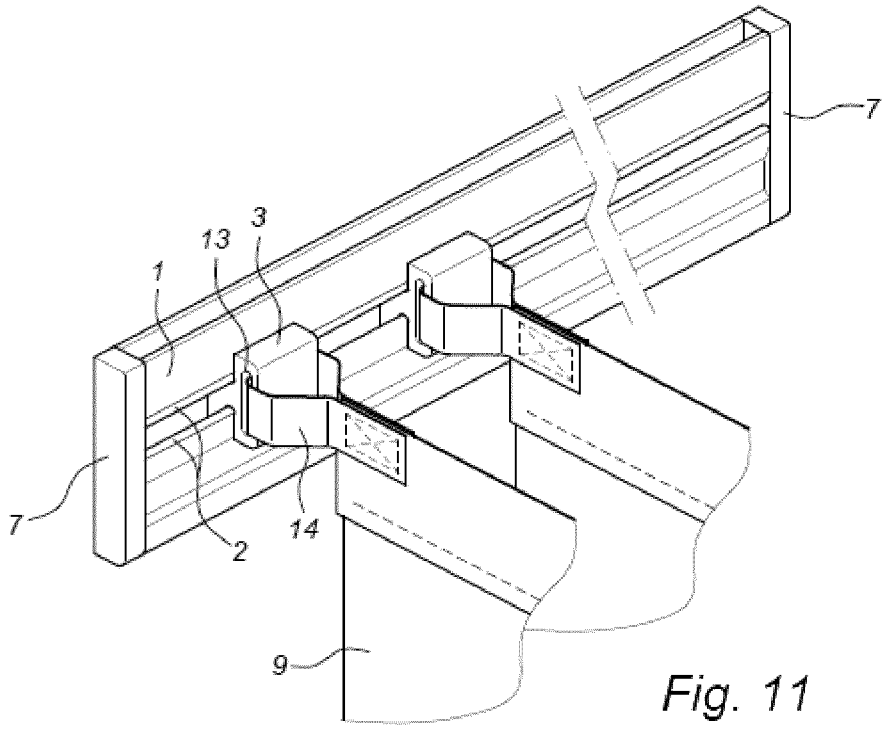
FIG. 11 presents a detailed view on the direct mounting of the gliding elements on the self-supportive dunnage. The gliding elements are positioned in the insert of the guiding rails according to an embodiment of the current invention.

In FIG. 11 a detailed view of an embodiment of a guiding rail (1) with insert (2) is presented. Both the distal and proximal ends of the guiding rail (1) are at least partially covered by an end cap (7), inhibiting the gliding elements (3) that are placed in the insert (2) can be removed. The dunnage (9) is self-supportively mounted between the guiding rails and is connected to the insert (2) of the guiding rail (1) by means of a gliding element (3). A textile band (14) is put in the slot (13) of the gliding element and stitched to the dunnage to connect the gliding element with the dunnage.

Figure 12:
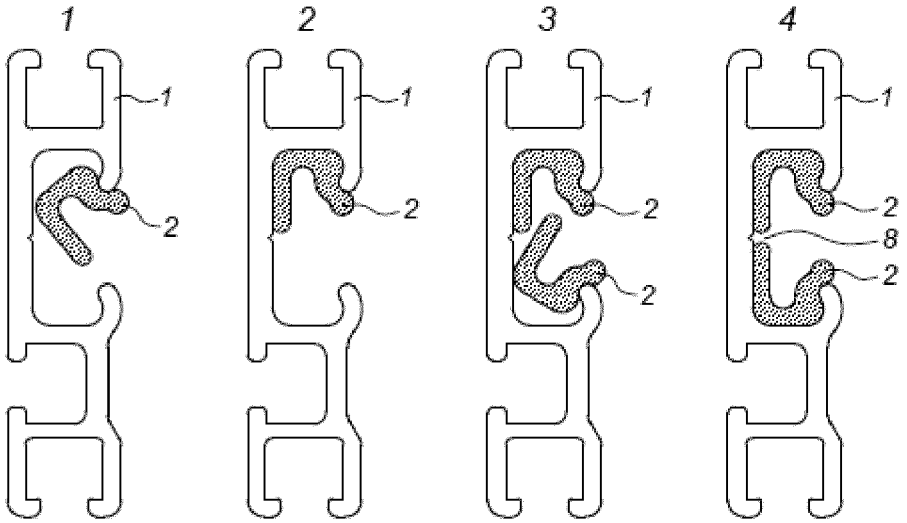
FIG. 12 illustrates the different assembly steps to install two insert components in the recess of a guiding rail according to an embodiment of the current invention.

In FIG. 12 a cross section of the different assembly steps of two insert components (2) in the guiding rail (1) according to an embodiment of the current invention is illustrated. In the first step, the first insert component (2) is mounted in the recess of the guiding rail. In the second step, the insert component is clicked and fixed in the upper half of the recess of the guiding rail. Due to the similarity of the shape of the upper part of the recess and the outer shape of the insert component, no additional fixation means are necessary to attach the component in the recess. In the third step, the second insert component is inserted in the lower half of the recess of the guiding rail. In the last step, both insert components are fixed in the guiding rail by clicking in the recess of the guiding rail. The guiding rail with mounted insert components is suitable for receiving gliding elements. A division line (8) between the two insert components is still apparent.

The numbers used in the figures referring to the different components of the invention are listed below.

1. Guiding rail
2. Insert
3. Gliding element
4. Dunnage support, like solid strut bar
5. Base of a transporting device like a box or container
6. Attachment system for mounting the rails
7. Removable end cap
8. Division along the transversal line of the insert
9. Dunnage structure, like transport bags or suspended pockets
10. Piece goods
11. Side panel
12. Lip of the insert
13. Slot of the gliding element
14. Flexible connection, like a textile band, between the gliding element and the dunnage It is supposed that the present invention is not restricted to any form of realization described previously and that some modifications can be added to the presented example of fabrication without reappraisal of the appended claim. In the figures, an insert is used to illustrate the use of an intermediate material reducing the friction between the gliding element and the guiding rail. It is equivalent to use a low-friction coating in the recess of the guiding rail. This coating similarly reduces the friction between the gliding element and the guiding rail.

Furthermore, this document does not intend to limit the shape of the dunnage, the material of the dunnage or the material used to assemble the transport device.

The invention claimed is:

1. A container for holding product therein during shipment, the container comprising:

a bottom and at least two sides, erecting from said bottom;

at least one set of guiding rails supported by the container sides, each guiding rail having a recess in a longitudinal direction along the guiding rail and the recess being at least partially provided with an intermediate material;

gliding elements being engaged with the intermediate material and slidable along the guiding rails, the gliding elements having an upper side and a lower side;

a dunnage structure that is movably coupled to the container by means of the gliding elements and operable for being slid along the guiding rails to vary the position of the dunnage structure and to receive product within the container;

wherein said dunnage structure is unsupported between the gliding elements by a strut bar;

wherein the intermediate material is a polymer insert provided within the recess of each guiding rail with the gliding elements received within the polymer insert, and the polymer insert has a downwardly extending, upper lip that terminates at a downwardly extending terminal end of the polymer insert, and has an upwardly extending, lower lip that terminates at an upwardly extending terminal end of the polymer insert;

wherein each guide rail has a downwardly extending, corresponding upper lip that terminates at a corresponding downwardly extending terminal end of the guide rail, and has an upwardly extending, corresponding lower lip that terminates at a corresponding upwardly extending terminal end of the guide rail;

wherein the downwardly extending terminal end of the upper lip of the polymer insert extends downwardly beyond the corresponding downwardly extending terminal end of the corresponding upper lip of the guiding rail to space the upper side of the gliding elements from the corresponding upper lip of the guide rail without the polymer insert covering an outer side of the corresponding upper lip of the guide rail; and wherein the upwardly extending terminal end of the lower lip of the polymer insert extends upwardly beyond the corresponding upwardly extending terminal end of the corresponding lower lip of the guiding rail to space the lower side of the gliding elements from the corresponding lower lip of the guide rail without the polymer insert covering an outer side of the corresponding lower lip of the guide rail.

2. The container for holding product therein during shipment according to claim 1, wherein the dunnage comprises flexible suspended pockets having a U-shaped cross section.

3. The container for holding product therein during shipment according to claim 1, wherein the dunnage is made of materials comprising plastic, woven textile, non-woven textile or a combination thereof.

4. The container for holding product therein during shipment according to claim 1, wherein the container is foldable or collapsible before and after use, whereby the container comprises opposing side structures that are moveable and can be manipulated into an erected position so that the container may contain a product placed therein during shipment and for subsequently being moved inwardly toward each other into a collapsed position for reducing the size of the container for return.

5. The container for holding product therein during shipment according to claim 1, wherein said guiding rail is manufactured of aluminum, plastic or steel or a combination thereof.

6. The container for holding product therein during shipment according to claim 1, wherein the gliding element is replaceable.

7. The container for holding product therein during shipment according to claim 1, wherein the distal and proximal ends of the guiding rail are at least partially covered by an end cap.

8. The container for holding product therein during shipment according to claim 1, wherein said polymer insert comprises a polymer selected from polyoefins selected from the group consisting of High-density polyethylene (HDPE), Ultra-high-molecular-weight polyethylene (UHMWPE), Medium density polyethylene (MDPE), polypropylene, polyurethane, polystyrene, cross-linked polyethylene (PEX or XLPE), polyoxymethylene (POM) or lubricated or modified versions of any of said polyolefins, and combinations thereof.

9. A container for holding product therein during shipment, the container comprising:

a bottom and at least two sides, erecting from said bottom;

at least one set of guiding rails supported by the container sides each guiding rail having a recess in a longitudinal direction along the guiding rail and the recess being at least partially provided with an intermediate material;

gliding elements being engaged with and slidable along the guiding rails;

a dunnage structure that is movably coupled to the container by means of the gliding elements and operable for being slid along the guiding rails to vary the position of the dunnage structure and to receive product within the container;

wherein the intermediate material is a polymer insert provided within the recess with the gliding elements received within the polymer insert and said polymer insert is divided in at least two components along a transversal division line of said polymer insert.

10. The container for holding product therein during shipment according to claim 9, wherein said polymer insert comprises a polymer selected from polyolefins selected from the group consisting of High-density polyethylene (HDPE), Ultra-high-molecular-weight polyethylene (UHMWPE), Medium density polyethylene (MDPE), polypropylene, polyurethane, polystyrene, cross-linked polyethylene (PEX or XLPE), polyoxymethylene (POM) or lubricated or modified versions of any of said polyolefins, and combinations thereof.

11. A container for holding product therein during shipment, the container comprising:

a bottom and at least two sides, erecting from said bottom;

at least one set of guiding rails supported by the container sides, each guiding rail having a recess in a longitudinal direction along the guiding rail and the recess being at least partially provided with an intermediate material;

gliding elements being engaged with the intermediate material and slidable along the guiding rails, the gliding elements having an upper side and a lower side;

a dunnage structure that is movably coupled to the container by means of the gliding elements and operable for being slid along the guiding rails to vary the position of the dunnage structure and to receive product within the container;

wherein said dunnage structure is unsupported between the gliding elements by strut bar a strut bar;

wherein the intermediate material is a polymer insert provided within the recess of each guiding rail with the gliding elements received within the polymer insert, and the polymer insert has a downwardly extending, upper lip that terminates at a downwardly extending terminal end of the polymer insert, and has an upwardly extending, lower lip that terminates at an upwardly extending terminal end of the polymer insert;

wherein each guide rail has a downwardly extending, corresponding upper lip that terminates at a corresponding downwardly extending terminal end of the guide rail, and has an upwardly extending, corresponding lower lip that terminates at a corresponding upwardly extending terminal end of the guide rail; and wherein the upwardly extending terminal end of the lower lip of the polymer insert extends upwardly beyond the corresponding upwardly extending terminal end of the corresponding lower lip of the guiding rail to space the lower side of the gliding elements from the corresponding lower lip of the guide rail without the polymer insert covering an outer side of the corresponding lower lip of the guide rail.

12. The container for holding product therein during shipment according to claim 11, wherein the dunnage comprises flexible suspended pockets having a U-shaped cross section.

13. The container for holding product therein during shipment according to claim 11, wherein the dunnage is made of materials comprising plastic, woven textile, non-woven textile, or a combination thereof.

14. The container for holding product therein during shipment according to claim 11, wherein the container is foldable or collapsible before and after use, whereby the container comprises opposing side structures that are moveable and can be manipulated into an erected position so that the container may contain a product placed therein during shipment and for subsequently being moved inwardly toward each other into a collapsed position for reducing the size of the container for return.

15. The container for holding product therein during shipment according to claim 11, wherein said polymer insert comprises a polymer selected from polyolefins selected from the group consisting of High-density polyethylene (HDPE), Ultra-high-molecular-weight polyethylene (UHMWPE), Medium density polyethylene (MDPE), polypropylene, polyurethane, polystyrene, cross-linked polyethylene (PEX or XLPE), polyoxymethylene (POM) or lubricated or modified versions of any of said polyolefins, and combinations thereof.

16. The container for holding product therein during shipment according to claim 11, wherein said guiding rail is manufactured of aluminum, plastic or steel, or a combination thereof.

17. The container for holding product therein during shipment according to claim 11, wherein the gliding element is replaceable.

18. The container for holding product therein during shipment according to claim 11, wherein the distal and proximal ends of the guiding rail are at least partially covered by an end cap.

* * * * *